US005372152A

United States Patent [19]

Dutch

[11] Patent Number: 5,372,152

[45] Date of Patent: Dec. 13, 1994

[54] HAIR ROLLER

[76] Inventor: Geraldine C. Dutch, P.O. Box 24597, Houston, Tex. 77229-4597

[21] Appl. No.: 74,400

[22] Filed: Jun. 10, 1993

[51] Int. Cl.[5] ..... A45D 2/18

[52] U.S. Cl. ..... 132/246; 132/247

[58] Field of Search ..... 132/245, 246, 247

[56] References Cited

U.S. PATENT DOCUMENTS

| | | | |
|---|---|---|---|
| 1,406,586 | 2/1922 | Scheib | 132/246 |
| 1,453,971 | 5/1923 | Calkins | 132/246 |
| 2,524,266 | 10/1950 | Licastro | 132/246 |
| 2,542,601 | 2/1951 | Van Cleef | 132/246 |
| 2,693,809 | 11/1954 | Spencer | 132/246 |
| 4,540,006 | 9/1985 | Collis | 132/246 |

FOREIGN PATENT DOCUMENTS

| | | | |
|---|---|---|---|
| 2116032 | 9/1983 | United Kingdom | 132/246 |

*Primary Examiner*—Gene Mancene
*Assistant Examiner*—Frank A. LaViola
*Attorney, Agent, or Firm*—Kenneth A. Roddy

[57] ABSTRACT

A bendable hair curling and waving roller has a length of bendable wire which is surrounded by a cylindrical foam cushion intermediate its ends and the wire and cushion are enclosed in an outer jacket of non-absorbent, machine washable material, such as satin, silk, or a satin-like synthetic fiber material. The wire is bendable yet has sufficient stiffness to enable it to retain its bent shape. The foam cushion gives the roller softness, enabling the wearer to lay her head against another surface with comfort. Hair is wrapped around the central portion of the roller and the outer ends of the roller are folded back onto itself to retain the wrapped hair in this position. The hair is held on the non-absorbent surface of the outer jacket by the inward folded ends until the hair has been set to the desired wave or curl and the non-absorbent outer jacket prevents depletion of hair's natural oils and moisture. A preferred non-absorbent outer jacket of satin material also prevents the hair from snagging during the rolling and unrolling operation which often occurs with conventional sponge rollers and rollers having absorbent materials. The non-absorbent outer jacket resists degradation by oils from hair and the types of lotions commonly used in hair dressing. After use, the rollers may be washed to allow the user to maintain sanitary conditions.

6 Claims, 1 Drawing Sheet

HAIR ROLLER

BACKGROUND OF THE INVENTION

1. Field of the Invention

This invention relates in general to certain new and useful improvements in a hair rolling apparatus, and more particularly, to an improved bendable hair rolling apparatus which is provided with a non-absorbent outer jacket that inhibits hair breakage and is thereby relatively safe in use.

2. Brief Description of the Prior Art

For many years, it has been a fad, if not a well established dress code, for women to wear their hair in stylish curls so that the hair presents a fashionable appearance. Thus, in accordance with this dress code, the hair is desired to be relatively curly. However, this is relatively difficult to accomplish if one's hair is naturally straight and requires the person wishing to curl her hair to obtain the services of a licensed cosmetologist.

Some women have attempted to roll their hair with conventional sponge rollers. However, sponge is an absorbent material and sponge rollers tend to dry out, and also to snag hair thus causing the hair to split and break. Accordingly, serious hair damage may result when a woman attempts to roll her hair using a so-called sponge roller.

Another significant problem which arises when an individual attempts to use sponge rollers is the fact that the user can only do so by wrapping the hair directly around the sponge. This direct contact with the sponge enables the sponge to absorb the hair's natural moisture, consequently the hair then becomes dry and brittle thus causing it to break.

In addition, many women simply resort to having their hair curled by a licensed cosmetologist on a periodic basis and relying only on the application of heat curling in which she has her hair curled around plastic or wire rollers and sits under a hot hair dryer for a period of one (1) or more hours in order to obtain the desired appearance.

A common type of hair curling roller comprises a plastic molding positioned around a short spongy roller body. The roller is used by wrapping hair around the roller body and fastening it with an elastic strap or plastic clip. Rollers of this type have several unsatisfactory features. They are heavy and uncomfortable, particularly when the user rests her head against another surface. The sponge has been known to cause severe damage to hair by snagging hair as it is wound around the sponge causing hair to become tangled and lodged into the sponge thus breaking the hair off. The sponge also causes damage to the hair as it is an absorbent material. A sponge's main function is to absorb, therefore it will absorb the hair's natural oils and moisture causing the hair to become dry and brittle resulting in splitting and breaking. These types of hair rollers are also unsanitary as the rollers are not designed to be washable thus retain the hair's dirty oils.

Heretofore, there has not been any effective device which permits a woman to roll her hair regularly without splitting, breaking, or discomfort on a relatively safe basis and which is highly effective in use.

The present invention is distinguished over the prior art in general by a bendable hair curling and waving roller having a length of bendable wire which is surrounded by a cylindrical foam cushion intermediate its ends and the wire and cushion are enclosed in an outer jacket of non-absorbent, machine washable material, such as satin, silk, or a satin-like synthetic fiber material. The wire is bendable yet has sufficient stiffness to enable it to retain its bent shape. The foam cushion gives the roller softness, enabling the wearer to lay her head against another surface with comfort. Hair is wrapped around the central portion of the roller and the outer ends of the roller are folded back onto itself to retain the wrapped hair in this position. The hair is held on the non-absorbent surface of the outer jacket by the inward folded ends until the hair has been set to the desired wave or curl and the non-absorbent outer jacket prevents depletion of hair's natural oils and moisture. A preferred non-absorbent outer jacket of satin material also prevents the hair from snagging during the rolling and unrolling operation which often occurs with conventional sponge rollers and rollers having absorbent materials. The non-absorbent outer jacket resists degradation by oils from hair and the types of lotions commonly used in hair dressing. After use, the rollers may be washed to allow the user to maintain sanitary conditions.

SUMMARY OF THE INVENTION

It is therefore, one of the primary objects of the present invention to provide a safe, comfortable hair rolling apparatus which is highly effective in use.

It is another object of this invention to provide a hair rolling apparatus which a portion of the main body is roundly shaped in order to efficiently allow the user a professional looking curl in a relatively safe manner.

A further object of this invention is to provide a comfortable hair rolling apparatus in which a soft sponge is enclosed in a non-absorbent fabric to facilitate cushioning thereof while preventing the sponge from absorbing the natural moisture of the user's hair.

A still further object of this invention is to provide a method of securing the hair to a hair roller until the desired effect is accomplished which is highly effective and relatively safe in use.

Other objects of the invention will become apparent from time to time throughout the specification and claims as hereinafter related.

The above noted objects and other objects of the invention are accomplished by a bendable hair curling and waving roller having a length of bendable wire which is surrounded by a cylindrical foam cushion intermediate its ends and the wire and cushion are enclosed in an outer jacket of non-absorbent, machine washable material, such as satin, silk, or a satin-like synthetic fiber material. The wire is bendable yet has sufficient stiffness to enable it to retain its bent shape. The foam cushion gives the roller softness, enabling the wearer to lay her head against another surface with comfort. Hair is wrapped around the central portion of the roller and the outer ends of the roller are folded back onto itself to retain the wrapped hair in this position. The hair is held on the non-absorbent surface of the outer jacket by the inward folded ends until the hair has been set to the desired wave or curl and the non-absorbent outer jacket prevents depletion of hair's natural oils and moisture. A preferred non-absorbent outer jacket of satin material also prevents the hair from snagging during the rolling and unrolling operation which often occurs with conventional sponge rollers and rollers having absorbent materials. The non-absorbent outer jacket resists degradation by oils from hair and the types of lotions commonly used in hair dressing. After use, the rollers may be washed to allow the user to maintain sanitary conditions.

DESCRIPTION OF THE PREFERRED EMBODIMENT

Figure 1:
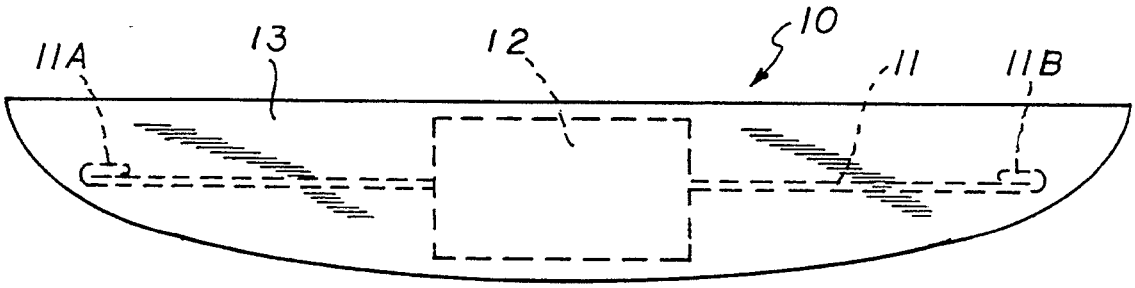
FIG. 1 is a side elevation of the hair roller in accordance with the present invention.
Figure 2:
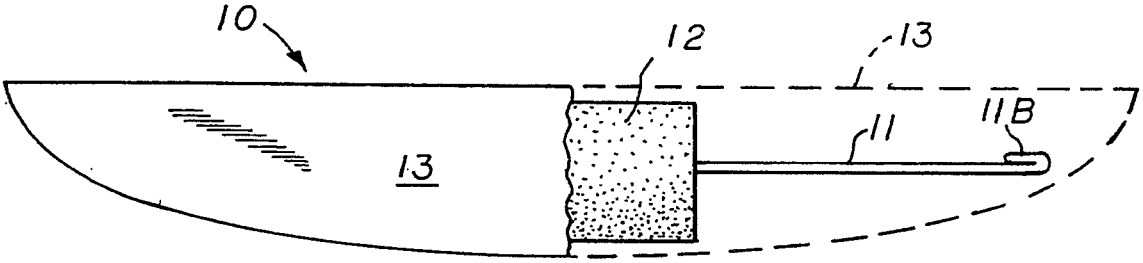
FIG. 2 is a side elevation of the hair roller shown with a portion of the non-absorbent outer jacket removed giving a view of the wire and resilient cushion enclosed within the outer jacket.

Referring to the drawings by numerals of reference, there is shown in FIGS. 1 and 2, a preferred roller 10 for curling or waiving hair. The roller 10 has a length of bendable chenille stem wire 11, approximately 6½" in length. Each end of the wire 11 is bent inward upon itself to form rounded ends 11A and 11B. The center portion of the chenille stem wire 11 is surrounded by cylindrical sponge 12, of foam material approximately 1" in diameter and 2" in length. The wire 11 and sponge 12 are enclosed within an outer jacket 13 of non-absorbent machine washable material, such as satin, silk, or a satin-like synthetic fiber material. The outer jacket 13 is approximately 1¾" wide at its center and approximately 7" in length. Thus, the outer ends of the jacket 13 extend beyond the ends 11A and 11B of the wire 11. The rounded ends 11A and 11B prevent the wire 11 from perforating the outer jacket 13. The roller may be fabricated by simply by introducing the stem wire 11 through the foam sponge 12 and then enclosing the foam sponge inside the outer jacket.

The chenille stem wire 11 is bendable yet has sufficient stiffness to enable it to retain its bent shape once applied to the hair and when folded onto itself, enables the user to secure the hair in place until the desired set is obtained. The sponge 12 gives the roller 10 softness, enabling the wearer to lay her head against another surface with comfort. The length of the roller 10 makes it suitable for use with either short hair or long hair. The stem wire 11 is not secured to the outer jacket 13 to enable relative movement between the wire and the jacket when the rollers are bent.

Figure 3:
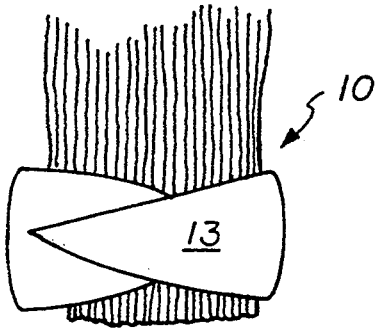
FIG. 3 is an elevational view showing one manner in which the hair roller may be used wherein the hair is wrapped around approximately the center one-third of the roller and the outer ends (each approximately one-third the length of the roller) are folded back toward the center of the roller to retain the wrapped hair in that position.

FIG. 3 shows one manner in which the roller 10 may be used. Hair is wrapped around the central portion of the roller and the outer ends of the roller are folded back onto itself to retain the wrapped hair in this position. The hair is wrapped on the cushioned portion of the roller and held on the non-absorbent surface of the outer jacket by the inward folded ends until the hair has been set to the desired wave or curl and the non-absorbent outer jacket prevents depletion of hair's natural oils and moisture. A preferred non-absorbent outer jacket of satin material also prevents the hair from snagging during the rolling and unrolling operation which often occurs with conventional sponge rollers and rollers having absorbent materials. There is considerable freedom as to the way in which the roller is folded to encompass a lesser or greater concentration of hair.

Figure 4:
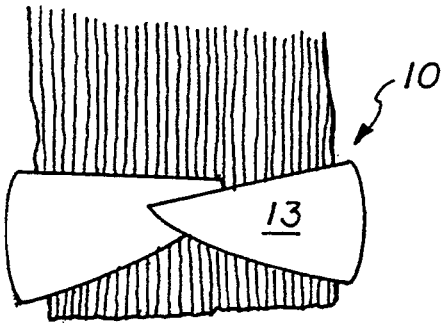
FIG. 4 is an elevational view showing the hair wrapped around approximately the center one-half of the roller and the outer ends (each approximately one-quarter the length of the roller) are folded back toward the center of the roller to encompass a greater thickness of the hair.

For example, FIG. 3 shows the hair wrapped around approximately the center one-third of the roller and the outer ends (each approximately one-third the length of the roller) are folded back toward the center of the roller to retain the wrapped hair in that position. FIG. 4 shows another way the roller may be secured to the hair wherein the hair is wrapped around approximately the center one-half of the roller and the outer ends (each approximately one-quarter the length of the roller) are folded toward the center of the roller to encompass a greater thickness of the hair.

The non-absorbent outer jacket 13 is preferably water repellent and resistant to degradation by oils from hair and the types of lotions commonly used in hair dressing. Desirably, it is also machine washable for sanitary purposes and for rejuvenation.

Because of the particular materials of construction, the rollers in accordance with the invention are not limited to use in any particular hair treating process. They may be used in association with perming lotions in a permanent wave process or with setting lotions. Alternatively the rollers may be used without additional lotions on hair which is wet or dry with or without additional heating.

The hair is wrapped on the cushioned portion of the roller and held on the non-absorbent surface of the outer jacket by the inward folded ends until the hair has been set to the desired wave or curl and the non-absorbent outer jacket prevents depletion of hair's natural oils and moisture which may cause splitting and breaking. A preferred non-absorbent outer jacket of satin material also prevents the hair from snagging during the rolling and unrolling operation which often occurs with conventional sponge rollers and rollers having absorbent materials. After use, the rollers may be washed to allow the user to maintain sanitary conditions.

While this invention has been described fully and completely with special emphasis upon a preferred embodiment, it should be understood that within the scope of the appended claims the invention may be practiced otherwise than as specifically described herein.

I claim:

1. A hair roller comprising;

a length of bendable wire having looped outer ends, a cylindrical cushion of resilient foam material having outer ends and a length approximately one-third the length of said wire surrounding approximately the middle one-third portion of said wire and each end of said wire extending a distance outwardly approximately one-third the length of said wire from the outer ends of said cushion, a flexible outer jacket of non-absorbent washable material selected from the group of materials consisting of satin, silk, and satin-like synthetic fiber material, said outer jacket completely enclosing said wire and said cushion and the recited material preventing snagging of the hair during a rolling and unrolling operation and preventing depletion of the hair's natural oils and moisture when rolled thereon, said outer jacket being slightly longer than said wire and loosely surrounding the outwardly extending ends of said wire to allow relative movement therebetween when bending said wire, and said wire outwardly extending ends surrounded by said outer jacket capable of being bent inwardly toward said cushion to reside closely adjacent said cushion and retain the bent position to secure and maintain hair on the surface of said non-absorbent outer jacket between said cushion and said inwardly bent ends of said wire to prevent depletion of the hair's natural oils and moisture while the hair is being set to the desired wave or curl.

2. The hair roller according to claim 1 in which;

said outer jacket non-absorbent washable material is satin.

3. An improved hair roller of the type having a length of bendable wire with looped outer ends and a cylindrical cushion of resilient foam material having outer ends and being shorter in length than the wire surrounding a middle portion of the wire and each end of the wire extending a distance outwardly from the outer ends of the cushion, the improvement comprising;

a flexible outer jacket of non-absorbent washable material selected from the group of materials consisting of satin, silk, and satin-like synthetic fiber material, said outer jacket completely enclosing the wire and the cushion and the recited material preventing snagging of the hair during a rolling and unrolling operation and preventing depletion of the hair's natural oils and moisture when rolled thereon, said outer jacket being slightly longer than the wire and loosely surrounding the outwardly extending ends of the wire to allow relative movement therebetween when bending the wire, and the outwardly extending ends of the wire surrounded by said outer jacket capable of being bent inwardly toward the cushion to reside closely adjacent the cushion and retain the bent position to secure and maintain hair on the surface of said non-absorbent outer jacket between the cushion and the inwardly bent ends of the wire to prevent depletion of the hair's natural oils and moisture while the hair is being set to the desired wave or curl.

4. The invention according to claim 3 in which;

said outer jacket non-absorbent washable material is satin.

5. A flexible outer jacket for installation on a hair roller of the type having a length of bendable wire with looped outer ends and a cylindrical cushion of resilient foam material having outer ends and being shorter in length than the wire surrounding a middle portion of the wire and each end of the wire extending a distance outwardly from the outer ends of the cushion;

said outer jacket formed of non-absorbent washable material selected from the group of materials consisting of satin, silk, and satin-like synthetic fiber material, said outer jacket shaped and sized to completely enclose the wire and the cushion when installed thereon and the recited material preventing snagging of the hair during a rolling and unrolling operation and preventing depletion of the hair's natural oils and moisture when rolled thereon, and said outer jacket being slightly longer than the wire and loosely surrounding the outwardly extending ends of the wire to allow relative movement therebetween when bending the wire, and the outwardly extending ends of the wire surrounded by said outer jacket capable of being bent inwardly toward the cushion to reside closely adjacent the cushion and retain the bent position to secure and maintain hair on the surface of said non-absorbent outer jacket between the cushion and the inwardly bent ends of the wire to prevent depletion of the hair's natural oils and moisture while the hair is being set to the desired wave or curl.

6. The flexible outer jacket according to claim 5 in which;

said outer jacket non-absorbent washable material is satin.

* * * * *